United States Patent [19]

Kiraly

[11] Patent Number: 4,776,053

[45] Date of Patent: Oct. 11, 1988

[54] SWIMMING POOL VACUUM CLEANER HYDROFOIL

[76] Inventor: J. George Kiraly, 3605 Kingston Blvd., Sarasota, Fla. 34238

[21] Appl. No.: 150,834

[22] Filed: Feb. 1, 1988

[51] Int. Cl.[4] ..... E04H 3/20

[52] U.S. Cl. ..... 15/1.7; 15/246

[58] Field of Search ..... 15/1.7, 246, 257 R

[56] References Cited

U.S. PATENT DOCUMENTS 3,003,168 10/1961 Shouldice ..... 15/1.7

4,637,087 1/1987 Feinberg ..... 15/1.7

FOREIGN PATENT DOCUMENTS 1068216 4/1960 Fed. Rep. of Germany ..... 15/1.7

584029 1/1947 United Kingdom ..... 15/1.7

*Primary Examiner*—Edward L. Roberts

*Attorney, Agent, or Firm*—Charles J. Prescott; Raymond H. Quist

[57] ABSTRACT

A hydrofoil attachment for swimming pool vacuum cleaner heads provides downward thrust during the pulling stroke. The hydrofoils pivot so as not to impede the pushing stroke. The hydrofoils are pivotally supported on a laterally extending rod. The rod is supported by triangular plates which mount on the axles of the wheels of the vacuum cleaner head.

11 Claims, 2 Drawing Sheets

18
16
12
30
20
10
14
32
38
22
26
24
36

34
26
24
32
22
14
38
36
20
12
30
10

32
22
24
36
F
18
40
16
30
12
28

Fig. 4
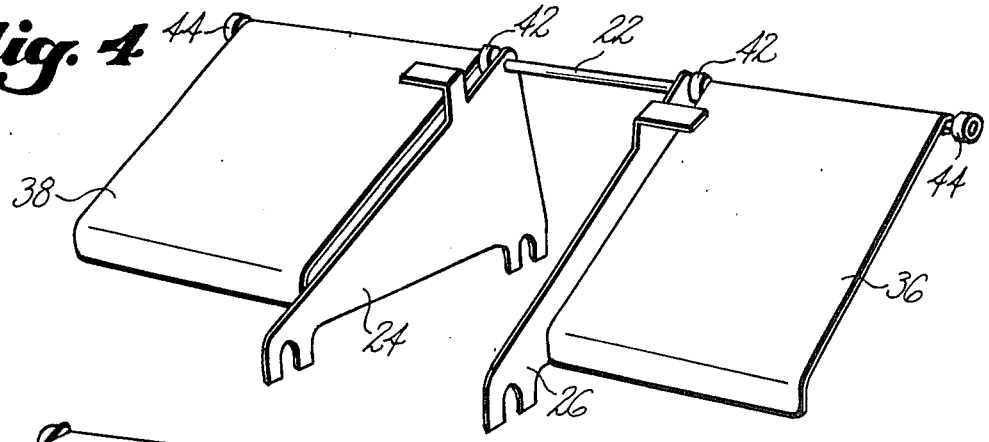
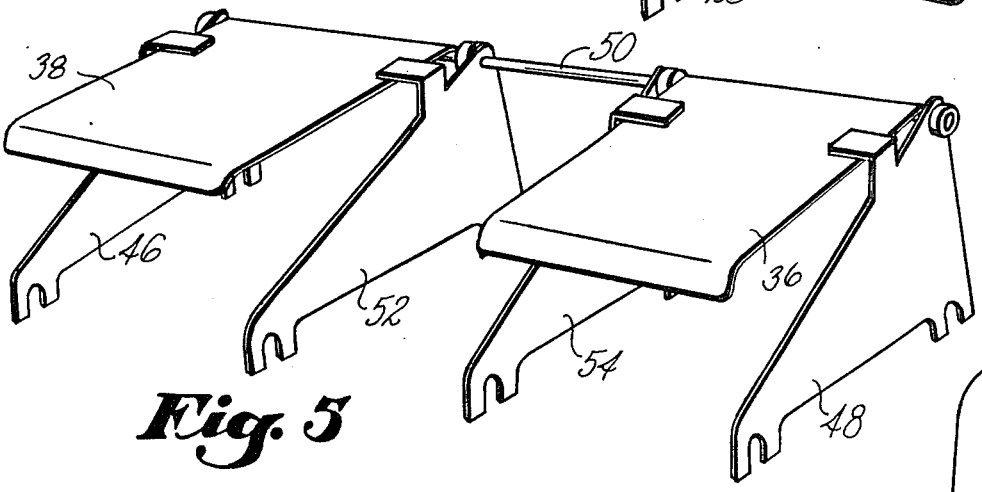
Fig. 5
Fig. 7
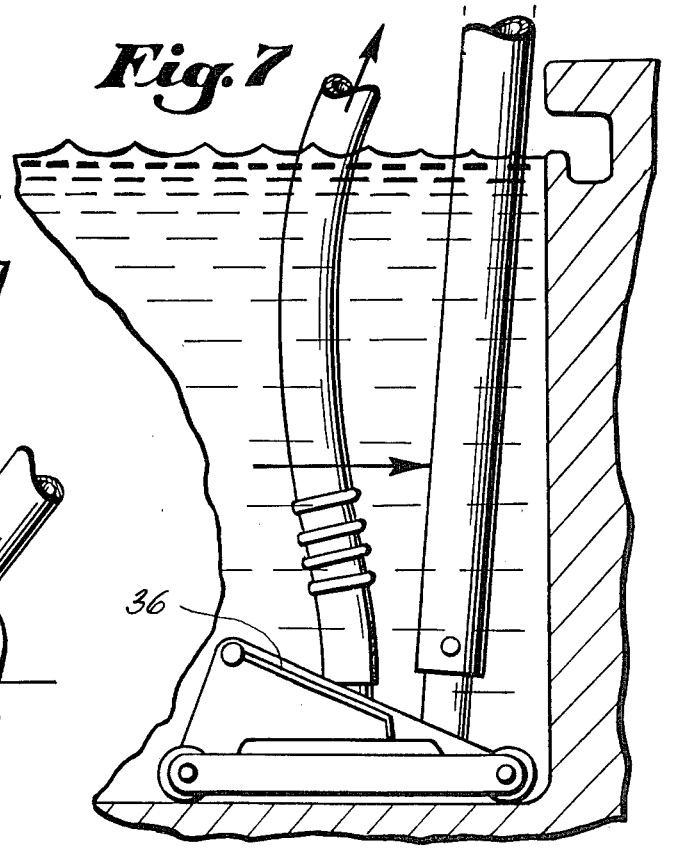
Fig. 6
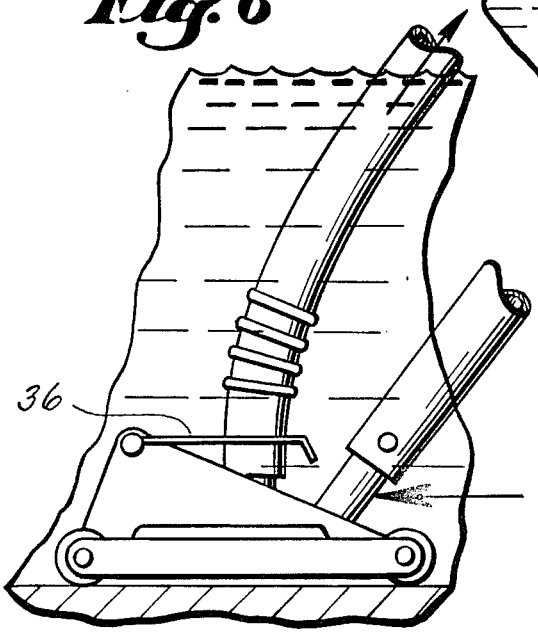

SWIMMING POOL VACUUM CLEANER HYDROFOIL

BACKGROUND OF THE INVENTION

1. Field of the Invention

This invention relates generally to swimming pool vacuum cleaners and more particularly to a hydrofoil attachment for improving the positioning of the vacuum cleaner against the pool surfaces.

2. Description of Related Art

One device which is widely used in cleaning the submerged surfaces of swimming pools is a vacuum cleaner. The vacuum cleaner has a head which may be supported by a plurality of wheels to keep the edges of the head only slightly above the pool surface. A hose, connected at one end to a vacuum and filtering system, is connected to the vacuum cleaner head to draw water and debris under the edges of the head to be carried for filtering. The vacuum cleaner head is moved by a maneuvering a long pole pivotally connected to the head. When the head is being pushed by the person standing on the edge of the pool, part of the thrust exerted tends to maintain all of the wheels of the vacuum cleaner head on the pool surface. When the head is being pulled back, however, the wheels tend to lift off the pool surface and the vacuuming effect is lost or substantially reduced. The backward stroke of the vacuum head is consequently essentially wasted as a cleaning stroke.

In the past the difficulty of maintaining a cleaning device against a submerged pool surface during both pushing and pulling strokes has been recognized, and solutions have been proposed.

U.S. Pat. No. 3,003,168, Shouldice, entitled: "Underwater Brush" discloses a water foil which is pivotally mounted on a brush backing vane. The foil has a larger area above the pivot than below the pivot in order to move the foil to the proper position.

U.S. Pat. No. 3,402,413, Gibellina, entitled: "Swimming Pool Brush Guide" discloses a guide designed to produce downward force on a brush during the pushing stroke and lifting force during the pulling stroke.

U.S. Pat. No. 4,637,087, Feinberg, entitled: "Swimming Pool Cleaner Attachment" discloses a water foil which is attached to a swimming pool cleaning brush. The foil is attached in a fixed position, but it includes openings which are closed by a flexible flap when the brush is pushed, and which are forced open by the flow of water when the brush is pulled. This structure is directed to aiding in the brushing of the vertical walls of a pool and performs its function during the pushing stroke.

It is therefore an object of this invention to provide hydrofoil apparatus for use with a swimming pool vacuum cleaner which will aid in keeping the vacuum cleaner head in proper operating position during the pulling stroke.

It is also an object of this invention to provide hydrofoil apparatus which is readily attached to conventional swimming pool vacuum cleaner heads.

In accordance with these and other objects, which will become apparent hereafter, the instant invention will now be described with reference to the accompanying drawings.

BRIEF DESCRIPTION OF THE DRAWINGS

FIG. 4 is a perspective view of a hydrofoil attachment in accordance with the invention;

FIG. 5 is a perspective view of another hydrofoil attachment in accordance with the invention;

FIG. 6 is a side elevation showing a swimming pool vacuum cleaner head with the hydrofoil apparatus in a pushing stroke; and FIG. 7 is a side elevation showing a swimming pool vacuum cleaner head with the hydrofoil apparatus in a pulling stroke.

SUMMARY OF THE INVENTION

A pair of pivoted hydrofoils are supported on a pivot rod to be moveable from a position where they will not impede the forward movement of the swimming pool vacuum cleaner head on the pushing stroke, to a position where they will aid in keeping the swimming pool vacuum cleaner head in operating position on the pulling stroke. The pivot rod is support above the vacuum cleaner head by a pair of plates mounted on the axle bolts of the wheels of the head. These plates also provide pivot limiters to prevent the hydrofoils from moving into inoperative positions.

DETAILED DESCRIPTION OF THE INVENTION

Figure 1:
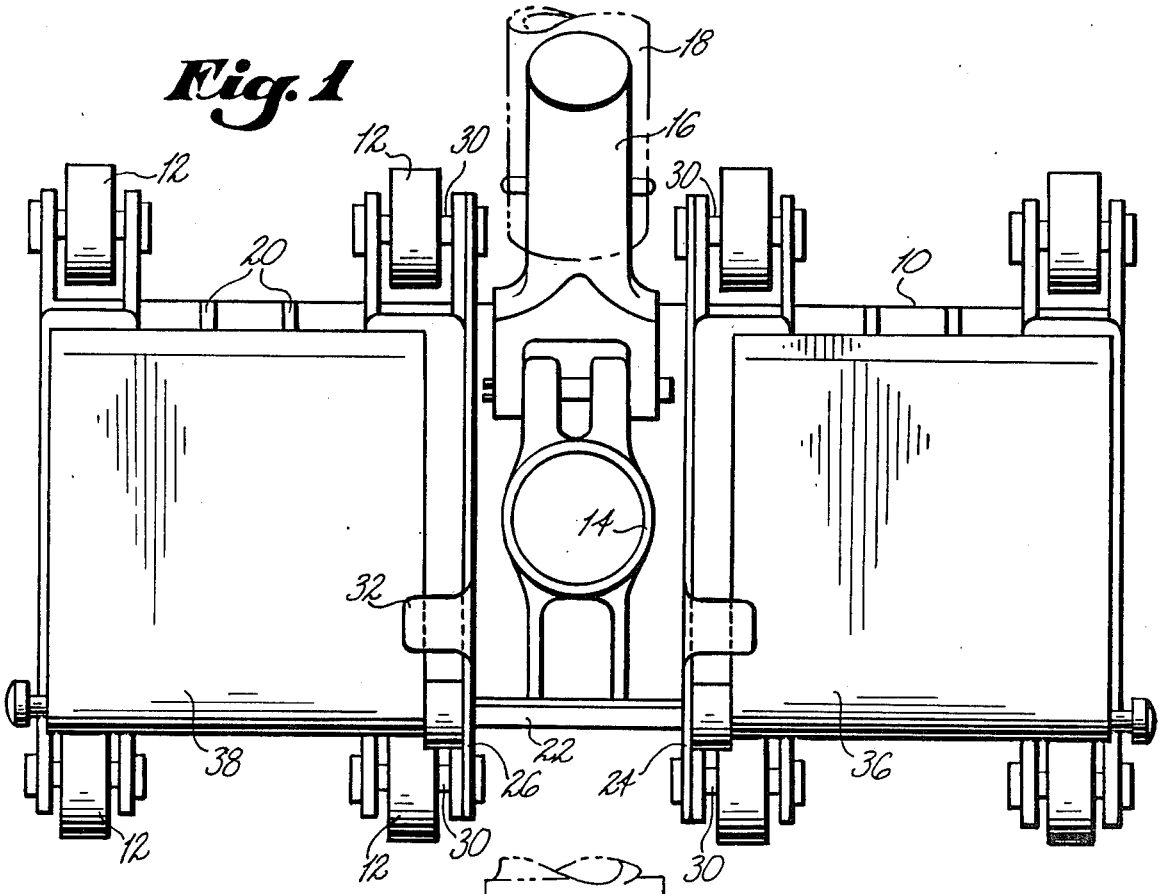
FIG. 1 is a plan view of a swimming pool vacuum cleaner head incorporating the hydrofoil apparatus of this invention.
Figure 2:
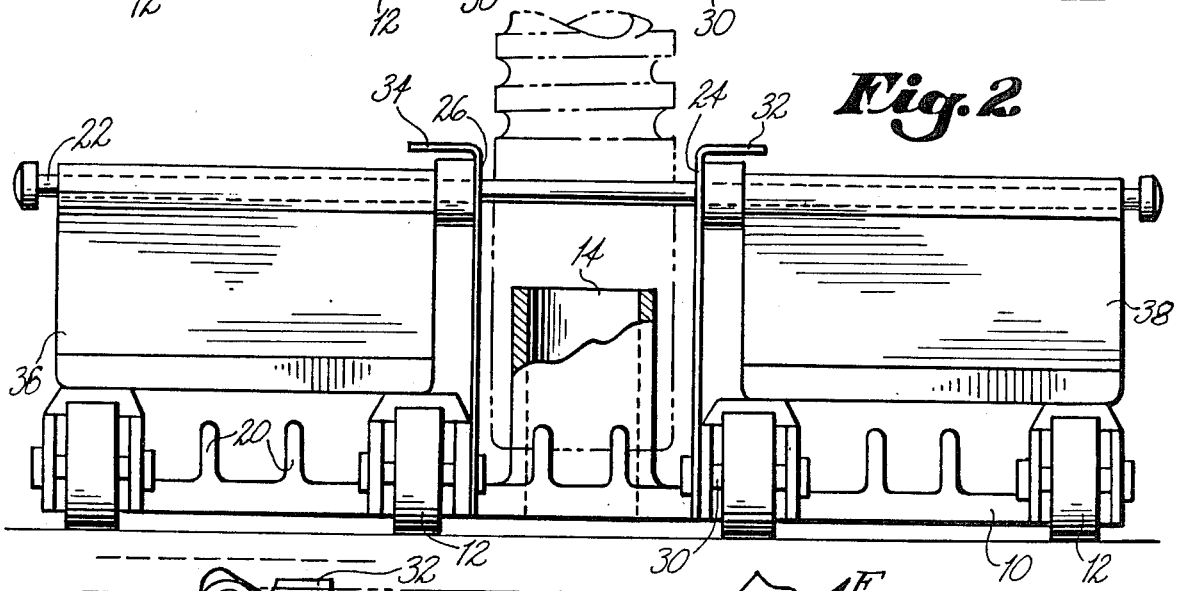
FIG. 2 is a front elevation of the device of FIG. 1.
Figure 3:
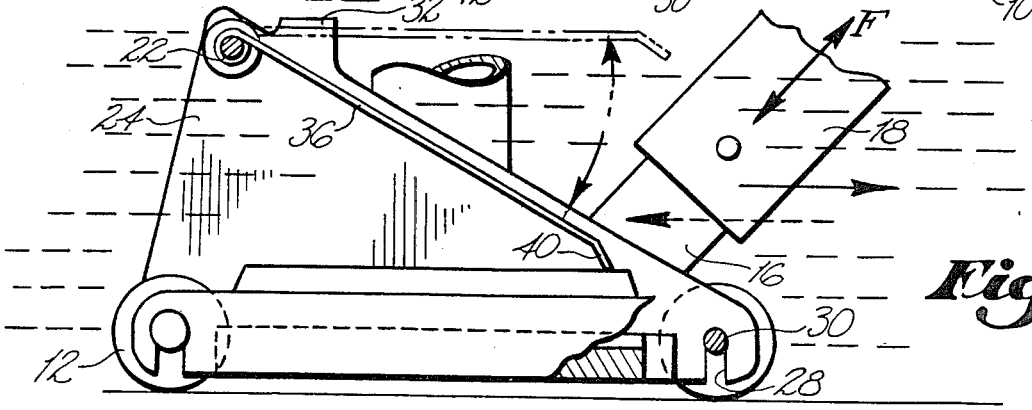
FIG. 3 is a side elevation of the device of FIG. 1.

Referring to FIGS. 1–3, swimming pool vacuum cleaner head 10 is supported by a plurality of spaced and parallel disposed wheels 12 so as to be in proper operating position when all wheels 12 are on the pool surface. In this position a small gap exists between the edges of the head and the pool surface. The head includes a centrally located hose connection 14, and a pivotally mounted stub shaft 16 serving as a pole mount to which a hollow pole 18 can be mounted. A plurality of parallel vanes 20 are also provided which extend upwardly from head 10.

In accordance with the invention, laterally extending rod 22 is supported by a pair of generally triangular plates 24 and 26. As shown in FIG. 3, a slot, such as slot 28, is provided at the bottom front and rear of plates 24 and 26 so that these plates can be mounted on the appropriate axles 30 of wheels 12.

Plates 24 and 26 include laterally extending pivot limiters 32 and 34 respectively. Pivotally mounted on rod 22 are hydrofoils 36 and 38. Hydrofoils 36 and 38 will be in the position shown in solid lines when the vacuum head is at rest and when it is moving backward because handle 18 is being pulled. Hydrofoils 36 and 38 will pivot upwardly to abut pivot limiters 32 and 34 respectively, when the vacuum head is moving forward because handle 18 is being pushed. Trailing edge 40 of the hydrofoils is bent down to promote this positioning. Trailing edge 40 also immediately causes the hydrofoil to move down when the pulling stroke begins because of the impinging water. This upward position permits vacuum head 10 to move forward with minimal drag imposed by the hydrofoil structure. When handle 18 is pulled, the back part of vacuum head 10 tends to lift up off the pool surface. Hydrofoils 36 and 38, however, produce a downward thrust which keeps vacuum head 10 on the pool surface in the proper attitude for maximum efficiency.

It will be noted, particularly in FIG. 3, hydrofoil 36 is mounted on pivot rod 22 by having the leading edge curved around the rod. Where the hydrofoils are fabricated from sheet metal, the metal can be bent to this configuration. Plastic hydrofoils can be molded to the same configuration.

In FIG. 4 the hydrofoil attachment of this invention is shown removed from the vacuum cleaner head. Washers, such as washers 42 may be positioned on pivot rod 22 to facilitate the pivoting of the hydrofoils. Self locking nut caps 44 at the ends of pivot rod 22 serve to hold the assembly together. Since the axles 30 of the wheels of the commercially available vacuum cleaner head are the shafts of through bolts and are held in place by nuts, it is a simple matter to loosen the appropriate nuts enough to install the apparatus. In the embodiment made, the triangular plates 24 and 26 were formed from stainless steel of approximately one twentieth inch thickness. The hydrofoils 36 and 38 were fabricated of stainless steel of approximately one fiftieth inch thickness.

FIG. 5 depicts an alternate embodiment having triangular pivot rod supports 46 and 48 located at the ends of pivot rod 50. Supports 46 and 48 may be the only pivot rod supports, or they may be used with pivot rod supports 52 and 54. Having four pivot rod supports permits the use of thinner material. The embodiment of FIG. 4 is preferred where the vacuum cleaner head is flexible, as the FIG. 5 embodiment tends to bind under these circumstances.

FIG. 6 shows, in side elevation, the vacuum cleaner head with the hydrofoil attachment during a pushing stroke. The hydrofoil is in the upper position so as not to impede the forward movement.

FIG. 7 shows, in side elevation, the pulling stroke, where the hydrofoil has been forced downward.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

I claim:

1. Swimming pool vacuum cleaner hydrofoil apparatus for use in combination with a swimming pool vacuum cleaner head having a substantially flat body supported by a plurality of spaced and parallel disposed wheels and a centrally located pivoted pole mount comprising:

a hydrofoil pivot rod laterally extending parallel to and spaced above the flat body of the vacuum cleaner head;

pivot rod support devices mounting said pivot rod to said vacuum cleaner head;

a pair of hydrofoils each having one edge pivotally mounted on said pivot rod and a trailing edge;

said trailing edges limiting the pivoting of said hydrofoils in one direction by abutting the vacuum cleaner head;

a pivot limiter for each of said hydrofoils; and said pivot limiters mounted to limit the pivoting of said hydrofoils in the other direction to be no more than parallel to the vacuum cleaner head.

2. Swimming pool vacuum cleaner hydrofoil apparatus in accordance with claim 1 wherein:

said pivot rod support devices are positioned adjacent to and on both sides of the pole mount.

3. Swimming pool vacuum cleaner hydrofoil apparatus in accordance with claim 2 wherein:

said pivot rod support devices are flat, triangular shaped plates; and said pivot limiters are lateral extensions of said plates.

4. Swimming pool vacuum cleaner hydrofoil apparatus in accordance with claim 3 wherein:

the wheels of the vacuum cleaner head are mounted on axles; and said plates have slots to fit over the axles.

5. Swimming pool vacuum cleaner hydrofoil apparatus in accordance with claim 1 wherein:

said hydrofoils are sheet material and have a downwardly bent trailing edge.

6. Swimming pool vacuum cleaner hydrofoil apparatus in accordance with claim 1 wherein:

said pivot rod support devices are positioned adjacent to the ends of said pivot rod.

7. Swimming pool vacuum cleaner hydrofoil apparatus in accordance with claim 6 further including:

pivot rod support devices adjacent to and on both sides of the pole mount.

8. A swimming pool vacuum cleaner head having a substantially flat body supported by a plurality of spaced and parallel disposed wheels mounted on axles and a centrally located pivoted pole mount, wherein the improvement comprises:

a hydrofoil pivot rod laterally extending parallel to and spaced above the flat body of the vacuum cleaner head;

a plurality of flat, triangular shaped plates supporting said pivot rod and mounted on axles of the vacuum cleaner head;

each of said plates having a laterally extending pivot limiter;

a pair of hydrofoils formed of sheet material each having one edge pivotally mounted on said pivot rod and a trailing edge;

said trailing edges are downwardly bent; and said trailing edges limiting the pivoting of said hydrofoils in one direction by abutting the vacuum cleaner head.

9. A hydrofoil attachment for swimming pool cleaning devices comprising:

a laterally extending hydrofoil pivot rod;

a plurality of laterally spaced pivot rod supports;

each of said supports having an upper portion formed to receive said pivot rod, and a lower portion formed to attach to a swimming pool cleaning device;

a plurality of hydrofoils;

each of said hydrofoils having a leading edge pivotally mounted on said pivot rod, and a trailing edge;

each of said trailing edges being downwardly bent; and at least one pivot limiter for each hydrofoil extending laterally from said upper portion of said pivot rod supports to limit the upward pivoting of said hydrofoils.

10. A hydrofoil attachment in accordance with claim 9 wherein:

there are two hydrofoils and two pivot rod supports.

11. A hydrofoil attachment in accordance with claim 10 wherein:

said pivot rod supports are triangular in shape and said pivot limiters are extensions of said plates.

* * * * *